US005538079A

United States Patent [19]

Pawlick

[11] Patent Number: 5,538,079

[45] Date of Patent: Jul. 23, 1996

[54] HEAT EXCHANGER WITH OBLONG GROMMETTED TUBES AND LOCATING PLATES

[76] Inventor: Daniel R. Pawlick, 39 Barwell Crescent, Etobicoke, Ontario, Canada, M9W 2W7

[21] Appl. No.: 197,320

[22] Filed: Feb. 16, 1994

[51] Int. Cl.[6] ..... F28F 9/06

[52] U.S. Cl. ..... 165/153; 165/69; 165/76; 165/173; 165/175; 165/DIG. 477

[58] Field of Search ..... 165/76, 69, 149, 165/152, 153, 173, 175

[56] References Cited

U.S. PATENT DOCUMENTS

| | | | |
|---|---|---|---|
| 1,921,278 | 8/1933 | Young | 165/81 |
| 2,969,956 | 1/1961 | Forgo | 165/175 |
| 3,245,465 | 4/1966 | Young | 165/148 |
| 3,447,603 | 6/1969 | Jones | 165/69 X |
| 3,633,660 | 1/1972 | Young | 165/69 |
| 3,739,840 | 6/1973 | Jones | 165/69 |
| 4,044,443 | 8/1977 | Chartet | 29/890.043 |
| 4,119,144 | 10/1978 | Kun | 165/175 |
| 4,159,035 | 6/1979 | Chartet | 165/173 |
| 4,344,478 | 8/1982 | Petaja et al. | 165/69 |
| 4,369,837 | 1/1983 | Moranne | 165/175 |
| 4,651,821 | 3/1987 | Moranne | 165/175 |
| 4,756,361 | 7/1988 | Lesage | 165/149 |
| 4,893,391 | 1/1990 | Zobel et al. | 29/890.046 |
| 4,938,284 | 7/1990 | Howells | 165/149 |
| 4,945,983 | 8/1990 | Dalo | 165/173 |
| 5,052,475 | 10/1991 | Grundy | 165/76 |
| 5,099,576 | 3/1992 | Shinmura | 29/890.049 |
| 5,123,482 | 6/1992 | Abraham | 165/173 |
| 5,190,101 | 3/1993 | Jalilevand | 165/176 |
| 5,205,354 | 4/1993 | Lesage | 165/173 |
| 5,226,235 | 7/1993 | Lesage | 29/890.047 |

FOREIGN PATENT DOCUMENTS

| | | | |
|---|---|---|---|
| 558913 | 7/1957 | Belgium | 165/173 |
| 1241636 | 9/1988 | Canada . | |
| 1317586 | 5/1993 | Canada . | |
| 91873 | 10/1983 | European Pat. Off. | 165/173 |
| 2435736 | 3/1975 | Germany | 165/175 |
| 463852 | 9/1975 | U.S.S.R. | 165/173 |
| 574450 | 1/1946 | United Kingdom | 165/153 |
| 631300 | 10/1949 | United Kingdom | 165/153 |

OTHER PUBLICATIONS

Glacier Heat Transfer Products, "Nu Wave Fin", Brochure, Date Unknown.

Glacier Heat Transfer Products, "Glacier Charge Air Coolers", Brochure, Date Unknown.

Glacier Heat Transfer Products, "Superior Technology at Work", Brochure, Date Unknown.

*Primary Examiner*—Leonard R. Leo

*Attorney, Agent, or Firm*—Riches, McKenzie & Herbert

[57] ABSTRACT

This invention relates to a heat exchanger having a core comprised of oblong shaped tubes having substantially flat longer sides and rounded shorter sides, the tubes being separated by and in contact with conventional wave-shaped external cooling fins. Locating plates are provided at both ends of the tubes to accurately align and to secure the tubes into position. The ends of the tubes are sealably secured to header plates by means of resilient grommets. The heat exchanger of the present invention provides better resistance to mechanical and thermal shocks than conventional heat exchangers having tubes soldered or brazed to the header plates and provides better cooling efficiency than heat exchangers having circular, grommetted tubes.

18 Claims, 3 Drawing Sheets

HEAT EXCHANGER WITH OBLONG GROMMETTED TUBES AND LOCATING PLATES

SCOPE OF THE INVENTION

This invention relates to an improvement in heat exchangers, and more particularly radiators and charge air coolers for diesel engines in buses and trucks using ambient air to cool air or liquid coolant.

BACKGROUND OF THE INVENTION

Conventional heat exchangers used in motor vehicles typically comprise a core interposed between two header tanks. The core typically comprises multiple rows of hollow flat-sided tubes separated by, and in contact with, wave-shaped external cooling fins. The width of the tubes is thus substantially equal to the "depth" of the core, i.e. the distance from the front to the back of the core. The header tank typically comprises a manifold which is sealably secured to a header plate. The header plate has holes which are adapted to receive the ends of the tubes. The tubes are typically sealably secured to the header plates by soldering or brazing.

A fluid, either a liquid or air coolant, typically enters the heat exchanger through an inlet in the manifold of a first header tank. The fluid is then directed into the tubes where it radiates heat through the tube walls and cooling fins, which are in turn cooled by air flowing between the tubes. The fluid flows through the tubes into a second header tank where it is collected and directed through an outlet in the manifold of the second tank.

The tubes, fins and header tanks are typically made from metals such as aluminum, copper, brass or steel. When all components of the heat exchanger are made from aluminum, a high temperature brazing oven is required to sealably secure the tubes to the header plates and to secure the external cooling fins to the tubes. However, high temperature brazing ovens are expensive and therefore increase manufacturing costs. When the components of the radiator are made from copper and/or brass, the tubes and fins are soldered together and the tubes are soldered to the header plates to form a fluid-tight seal. When the radiator components are made from copper, for example, all the junctions between the various copper parts are precoated with solder or a solder tape is placed between the elements. The components are then clamped together and heated to provide soldered joints. One major disadvantage of heat exchangers having soldered or brazed seals is that such seals are prone to failure when subjected to repeated thermal or mechanical shocks. Thermal shocks may occur, for example, when an engine is started in cold weather and hot coolant flows suddenly into a cold radiator.

Some of the disadvantages of radiators having soldered or brazed seals have been overcome in the prior art by providing a joint sealed by a grommet between the tube and header plate. Such a construction is taught by U.S. Pat. Nos. 4,756,361; 5,205,354; and 5,226,235 to Lesage. These patents teach a system wherein tubes having a circular cross-section are sealably secured to a header plate provided with circular holes. Each hole in the header plate is provided with an individual resilient grommet having a circular bore which is adapted to receive and form a seal with the sides of the circular tube received in the hole. Heat exchangers having this construction have much better resistance to mechanical and thermal shocks than heat exchangers in which the tubes are soldered or brazed to the header plates. However, a primary disadvantage of the Lesage heat exchanger is that cooling efficiency is impaired, particularly where air is the coolant.

Because the tubes taught by the Lesage patents are circular and do not have flat sides, it is not possible to use conventional external cooling fins in the form of wave-shaped plates between the tubes and extending along a longitudinal axis defined by the length of the tubes. Instead, Lesage teaches cooling fins in the form of apertured plates which extend transversely to the longitudinal axis and which are provided with holes through which the tubes are inserted. A large number of these transverse fins must be provided for each radiator. The holes in the transverse fins have collars extending from one side of the fin to provide heat exchange contact between the tubes and each fin. After insertion through the fins, Lesage teaches that the tubes are mechanically expanded to provide a friction fit in the holes of the fins.

The transverse fins of Lesage must be punched with the holes for the tubes. This substantially increases manufacturing costs. On the other hand, conventional prior art fins comprising wave-shaped thin metal sheets do not need punching nor do they have to be manufactured with as high a degree of precision as the transverse fins taught by Lesage.

Conventional wave-shaped fins can be manufactured having a large number of undulations per unit length, thus increasing the surface area of the cooling fin and improving the efficiency of the heat exchanger. Furthermore, these conventional fins have a much greater area of contact with the sides of the tubes than the transverse fins taught by Lesage, thus increasing efficiency of heat transfer. In order to obtain the same efficiency, the heat exchanger of Lesage must be provided with a very large number of transverse cooling fins spaced a very small distance apart. The collars on the transverse fins of Lesage limit the number of transverse fins which may be provided on a given length of tube. Accordingly, conventional wave-shaped cooling fins can be more economical and efficient than the transverse fins taught by the Lesage patents.

In general, heat exchangers having flat-sided tubes and conventional wave-shaped external cooling fins are more efficient than the Lesage heat exchanger, particularly in cooling systems where air is the coolant. Flat sided tubes generally have a larger surface area than circular tubes and thus can provide more efficient heat transfer.

Further, the tubes of the Lesage heat exchanger core are arranged in a rectangular array rather than a single row. This leaves gaps between the tubes from the front to the back of the core, reducing cooling efficiency. In contrast, a core comprising a single row of flat-sided tubes provides a continuous cooling surface throughout the depth of the core. Also, the wave-shaped cooling fins between the flat-sided tubes are in continuous contact with the flat-sided tubes throughout the entire depth of the core.

SUMMARY OF THE INVENTION

To at least partially overcome the disadvantages of previously known heat exchangers, the present invention provides a heat exchanger having a core comprised of oblong shaped tubes having substantially flat longer sides and rounded shorter sides, the tubes being separated by and in contact with conventional wave-shaped external cooling fins. Locating plates are provided at both ends of the tubes to accurately align and to secure the tubes into position. The ends of the tubes are sealably secured to header plates by means of resilient grommets.

One object of the present invention is to provide a heat exchanger having improved resistance to mechanical and thermal shocks which utilizes oblong shaped tubes and conventional wave-shaped external cooling fins.

Another object of the present invention is to provide a heat exchanger having oblong shaped tubes and conventional wave-shaped external cooling fins wherein the tubes are not secured to header plates by brazing or soldering.

Another object of the present invention is to provide a heat exchanger having oblong shaped tubes which are sealably secured to a header plate by means of resilient grommets.

Another object of the present invention is to provide a heat exchanger having oblong shaped tubes sealably secured to a header plate by means of grommets wherein the depth of the core is substantially equal to the width of a single tube.

Another object of the present invention is to provide locating plates which secure and accurately align the tubes prior to insertion of the tubes into the header plate.

Another object of the present invention is to provide a method for assembling a heat exchanger having oblong shaped tubes and conventional wave-shaped external cooling fins wherein the tubes are sealably secured to header plates by means of resilient grommets.

The inventor has surprisingly found that a fluid-tight seal can be produced between an oblong shaped tube having longer substantially flat sides and shorter rounded sides and a header plate by means of resilient grommets. The use of oblong shaped tubes allows the use of conventional wave-shaped external cooling fins between adjacent tubes while at the same time providing a seal between the tube and header plate which is highly resistant to both mechanical and thermal shocks. Furthermore, the inventor has found that by preassembling a core having locating plates near the ends of the tubes, the tubes can be aligned with a high degree of precision, which is necessary to achieve a fluid-tight seal with the grommets.

Accordingly, the heat exchanger of the present invention combines the superior cooling capabilities of a heat exchanger having flat-sided tubes and conventional wave-shaped external fins with the improved thermal and mechanical shock resistance of a heat exchanger wherein the tubes are sealed to the header plate by means of resilient grommets preferably of silicon rubber.

The core of the heat exchanger according to the present invention comprises a number of oblong tubes separated by wave-shaped external cooling fins, the ends of the tubes being received by and projecting through a pair of locating plates. The core preferably comprises a single row of tubes and the components of the core are preferably made from metals such as copper, aluminum, brass or steel.

The oblong tubes are preferably of seamless construction and have substantially flat longer sides and rounded shorter sides. The wave-shaped external cooling fins extend along a longitudinal axis defined by the length of the tubes and are sandwiched between adjacent tubes. The width of the cooling fins is preferably substantially equal to the width of the flat sides of the tubes. The cooling fins preferably have a corrugated or castellated cross-section providing for flow passages across the tubes, that is, transverse to the longitudinal axis of the tubes. The cooling fins do not extend to the ends of the tubes in order to allow the locating plates to fit over the ends of the tubes. The substantially flat locating plates are provided with holes which are adapted to closely fit the tubes.

The locating plates give the core rigidity and accurately locate the ends of the tubes relative to one another. It is preferred that the ends of the tubes be located in the locating plate to within $1\times10^{-2}$ to $5\times10^{-3}$ inches of their desired positions.

The cooling fins are preferably joined to the tubes by brazing or soldering. The tubes may also be brazed or soldered to the locating plates, however the locating plates may be provided with holes which fit the tubes sufficiently closely that a friction fit is provided between the tubes and locating plates.

The header tanks of the heat exchanger according to the present invention each include a header plate having a number of holes adapted to receive the ends of the oblong tubes of the core. Each hole in the header plate is provided with an individual resilient grommet which is adapted to receive and form a fluid-tight seal about the oblong shaped tubes of the core. The header tanks are preferably made from metals such as copper, steel, brass or aluminum.

The heat exchanger of the present invention is assembled by inserting the ends of the tubes of the assembled core through the bores of the grommets in the header plate. It is preferred that the tubes be inserted far enough through the grommets that the locating plates abut the flanges of the grommets in the header plate. This provides a cushioning effect for the core and results in the heat exchanger being better able to withstand mechanical shocks. This abutment also results in improved support for the tubes by preventing them from moving axially and becoming dislodged from either of the header plates.

It is preferred that the ends of the external cooling fins, which do not extend over the entire length of the tubes, extend throughout the entire length of the tubes between the locating plates so that the external fins abut the locating plates. Since the external fins are attached to the tubes by brazing or soldering, the abutment of the fins against the locating plates provides additional support for the tubes by preventing them from moving axially relative to the locating plates and becoming dislodged from the header tanks.

It is preferred that the oblong tubes be provided with internal supporting means, preferably in the form of internal supporting fins. Such fins may, for example, comprise thin metal sheets which are formed to have a wave-shaped cross-section similar to the wave-shaped cross-section of the external cooling fins. The internal fins preferably define flow passages parallel to the longitudinal axis of the tubes. It is preferred that the internal supporting fins have a castellated or corrugated cross-section. The internal supporting fins preferably engage both of the longer substantially flat sides of the tubes from the inside, thus providing support for the flat sides of the tube and providing heat exchange with the sides of the tube.

The internal supporting means are preferably present near the ends of the tubes where the tubes pass through the grommets in the header plates. The grommets exert inward pressure on the sides of the tube. This pressure may cause the long flat sides of the tube to deform by becoming concave, with possible leaking of the seal with the grommet. It is particularly preferred to provide supporting means throughout the entire length of tube, supporting the flat sides of the tube along its entire length.

The tubes of the heat exchanger of the present invention are preferably formed by flattening thin walled round tubes to provide the preferred seamless construction. The internal supporting fins, having a width close to that of the flattened oblong tube, must therefore be inserted axially into the tube. In one preferred embodiment, the internal fins are simply axially inserted directly into the oblong tubes. In another preferred embodiment, a round tube is partially compressed so that its shape is nearly oblong and so that the width of the partially flattened tube is sufficient to accomodate the width of the internal supporting fin. The internal supporting fin is then inserted axially into the partially flattened tube. The partially flattened tube containing the internal supporting fin is then further compressed so that the longer flat sides of the tube engage the internal supporting fin and thus provide a friction fit between the internal supporting fin and the walls of the tube.

In another embodiment, the tubes are partially compressed as described above. The partially compressed tubes containing the internal supporting fins are then assembled into a tube stack, which comprises a number of tubes piled one on top of each other alternating with and separated by external cooling fins. The entire stack may then be compressed so that the long sides of the tubes are completely flattened and engage the internal supporting fins. It is particularly preferred to maintain compression on the tubes while simultaneously joining the internal fins, the tubes and the external fins by brazing or soldering.

In one aspect, the present invention provides a heat exchanger, comprising a core interposed between first and second header tanks, wherein: (a) said core comprises (i) a plurality of substantially parallel open-ended tubes having first and second ends, all the tubes being of substantially the same length, each tube having a substantially oblong cross section with longer substantially flat sides and shorter rounded sides; (ii) first and second substantially flat locating plates transverse to the tubes, each locating plate having a plurality of holes shaped to closely fit over the ends of the tubes, the first and second ends of the tubes projecting through the holes in the first and second locating plates respectively, the holes in the respective locating plates being in registry with one another so as to precisely align the tubes relative to one another; and (iii) a plurality of external cooling fins extending longitudinally along the tubes substantially the entire distance between the upper and lower locating plates, said fins comprising thin plates having a wavy cross section along a longitudinal axis parallel to the length of the tubes, said fins being sandwiched between the flat sides of adjacent tubes to define a plurality of air passages between adjacent tubes substantially transverse to the longitudinal axis; (b) said header tanks comprising (i) a substantially flat header plate transverse to the longitudinal axis, the header plate having an inner surface facing the inside of the header tank and an outer surface facing the outside of the header tank, a plurality of holes being formed through the header plate to receive the ends of the tubes, the header plate holes having edges about their perimeter; (ii) individual resilient grommets in said header plate holes, the grommets having an outside wall and a central bore adapted to form a fluid-tight seal with the sides of the tubes, the outside wall of each grommet having a radial groove facing outward from said bore, the groove defining an outer flange on the outside wall of the grommet, the groove being adapted to receive the edges of a header plate hole so that the outer flange overlies the outer surface of the header plate and a fluid-tight seal is formed between the grommet and the edges of the header plate hole; and wherein the first end of each tube is received in a grommet bore in the first header tank and the second end of each tube is received in a grommet bore in the second header tank, the ends of the tubes projecting through the grommet bores.

In another aspect, the present invention provides a method for assembling a heat exchanger comprising a core interposed between upper and lower header tanks, comprising: forming a rigid core by assembling at least one tube stack wherein open ended tubes of substantially the same length, having first and second ends, and having substantially oblong cross sections with longer substantially flat sides and shorter rounded sides, are stacked one on top of the other, with external cooling fins sandwiched between the flat sides of adjacent tubes in the stack such that the external fins do not extend to the ends of the tubes, the external cooling fins comprising thin plates having a wavy cross section along a longitudinal axis parallel to the length of the tubes; securing the tubes and accurately aligning the tubes relative to one another by inserting the first and second ends of the tubes into first and second locating plates respectively, each locating plate being substantially flat and transverse to the longitudinal axis, each locating plate having a plurality of holes shaped to closely fit over the ends of the tubes, the first and second ends of the tubes projecting through the holes in the first and second locating plates respectively, the holes in the respective locating plates being in registry with one another so as to precisely align the tubes relative to one another; and inserting the first and second ends of the tubes into first and second header tanks respectively, the header tanks each having a substantially flat header plate provided with a plurality of holes, each header plate hole being provided with an individual resilient grommet.

BRIEF DESCRIPTION OF THE DRAWINGS

Further aspects and advantages of the present invention will become apparent from the following description, taken together with the accompanying drawings, in which.

DESCRIPTION OF THE PREFERRED EMBODIMENTS

Preferred forms of the heat exchanger of the present invention and a preferred method for its assembly are now described with reference to FIGS. 1 to 3.

Figure 1:
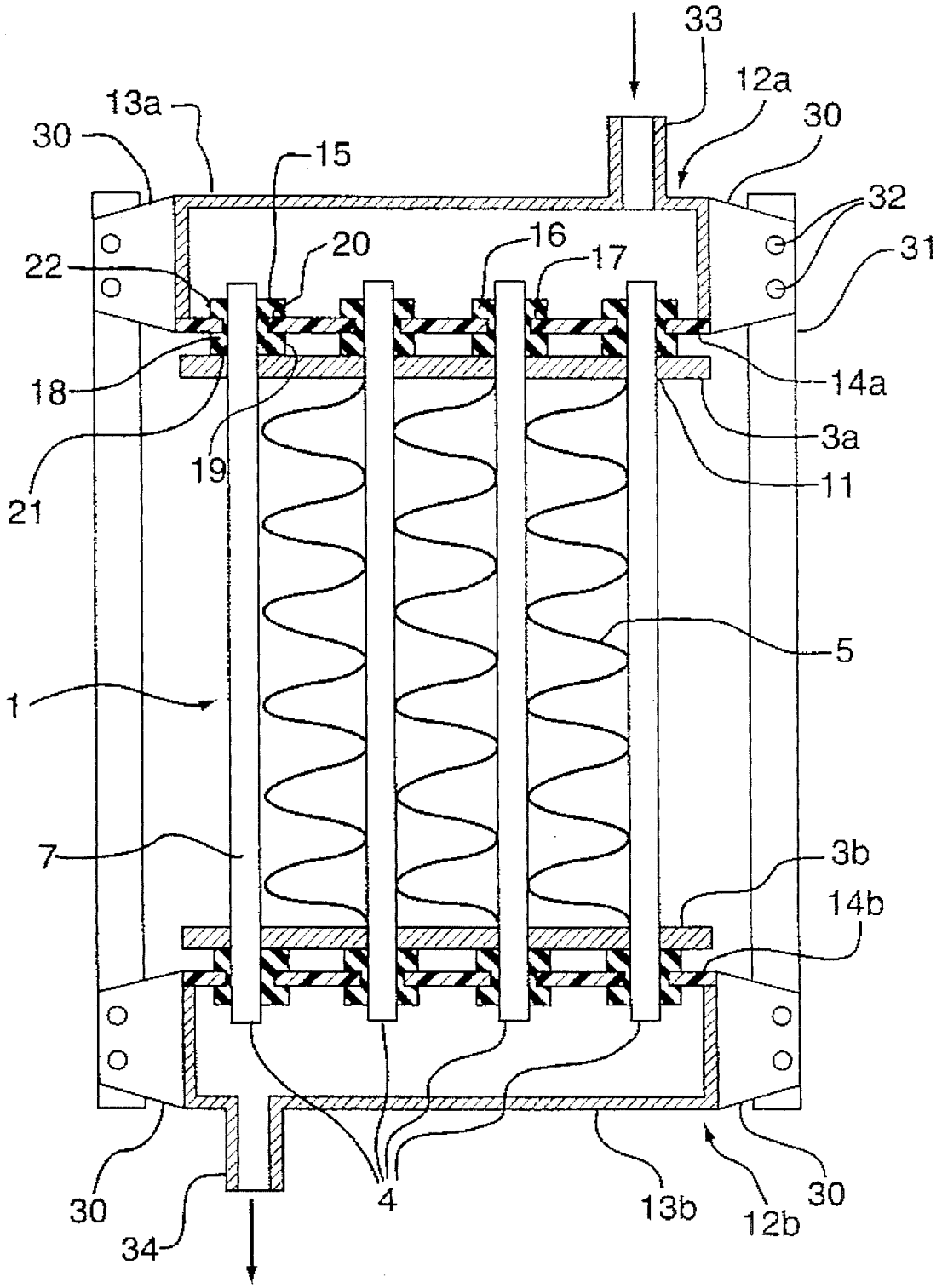
FIG. 1 is a cross-sectional frontal view of an assembled heat exchanger according to the present invention with its tubes orientated vertically.
Figure 2:
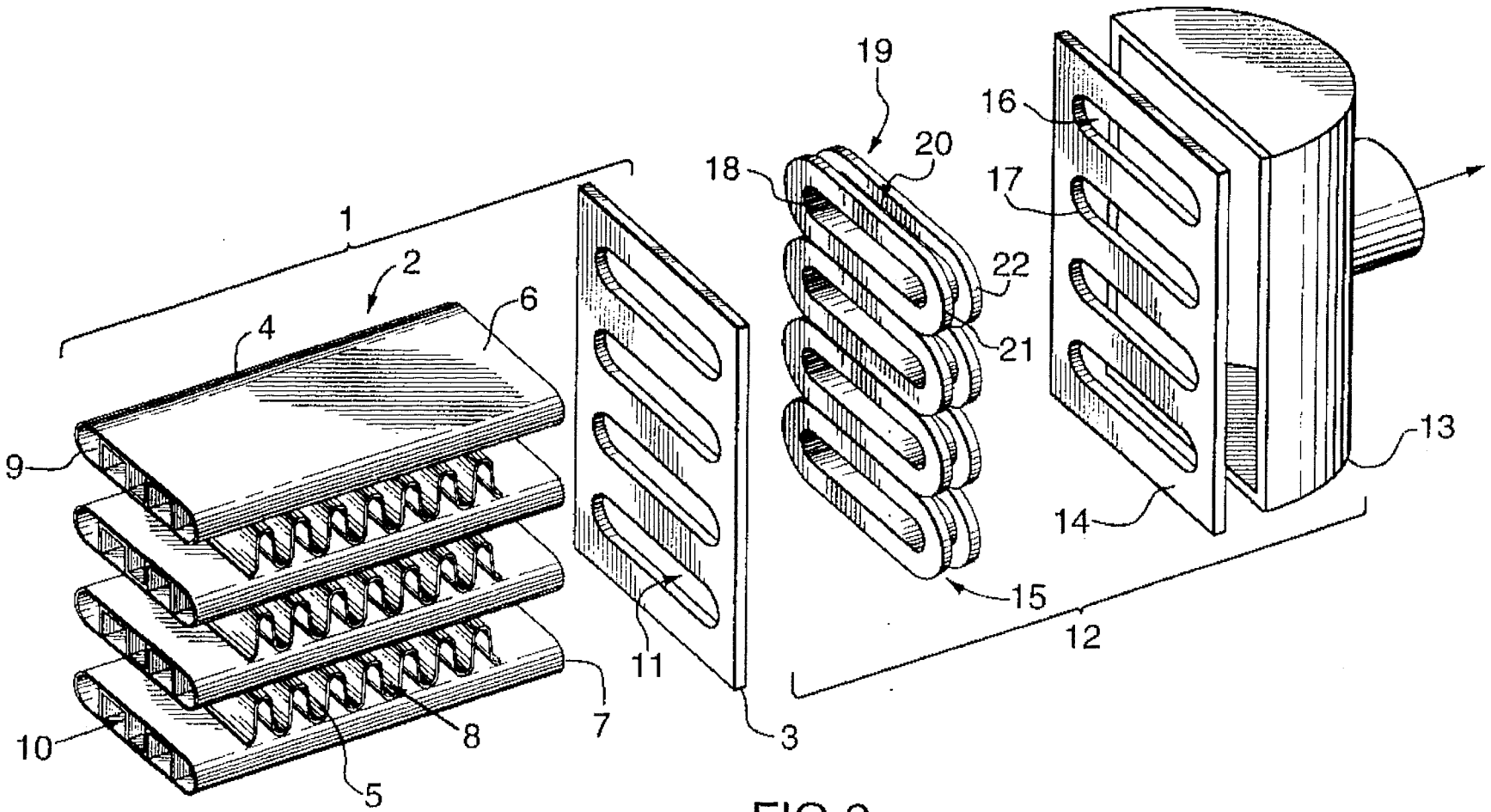
FIG. 2 is an exploded perspective view of portions of the partially assembled heat exchanger shown in FIG. 1, however orientated with the tubes horizontal.

FIG. 2 illustrates a right hand portion of a heat exchanger according to the present invention in a partially assembled, exploded state. A cross-section of the entire heat exchanger is seen in FIG. 1. The core 1 of the heat exchanger is shown in FIG. 2 as comprising a complete, assembled tube stack 2 and a substantially flat locating plate 3 at the right hand end of tube stack 2. As seen in FIG. 1, the core 1 additionally comprises a second similar locating plate 3, not shown by FIG. 2, located at the left hand end of tube stack 2.

To the right of core 1 in FIG. 2 is a header tank 12 shown in an exploded state. The header tank 12 in FIG. 2 is shown as comprising a manifold 13, a header plate 14 and four individual resilient grommets 15. As shown in FIG. 2, the resilient grommets 15 are preferably oblong in shape. As shown in FIG. 1, the heat exchanger additionally comprises a similar second header tank 12 on the left side of core 1, not shown in FIG. 2, which also comprises a manifold 13, a header tank 14 and individual resilient grommets 15.

Figure 3:
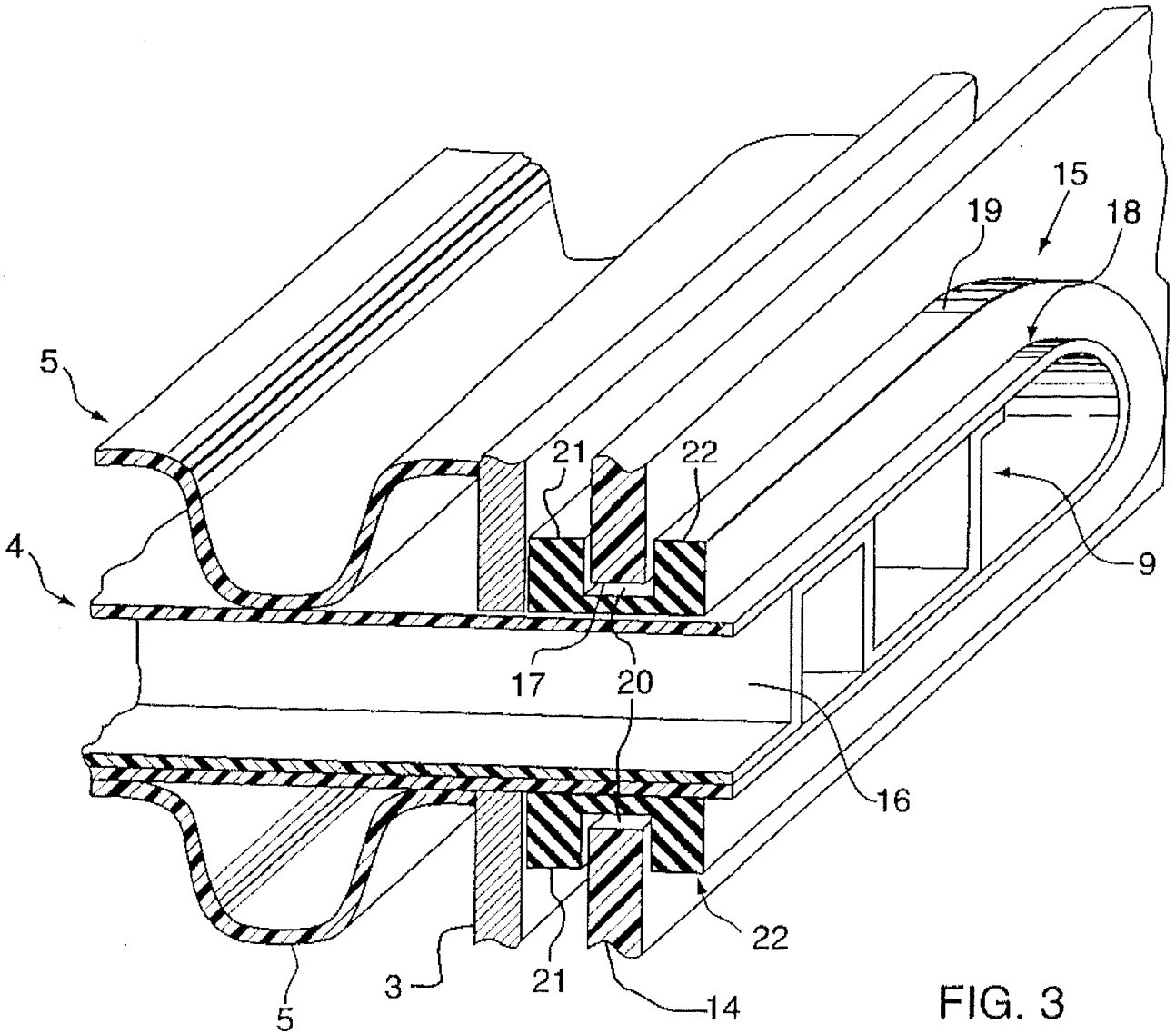
FIG. 3 is a partial, cross-sectional perspective view of the heat exchanger of FIG. 1 showing the manner in which a tube is sealably secured to a header plate, and with the tube orientated horizontally.

FIG. 3 best illustrates the manner in which the end portion of a single tube 4 is received within one of the header plates 14. FIG. 3 illustrates only that part of locating plate 3 and header plate 14 which surround tube 4. Neither the adjacent tubes 4 nor the manifold 13 are shown in FIG. 3.

Tube stack 2 is shown in FIG. 2 as an assembly comprising oblong tubes 4, defining a longitudinal axis along the length of the tubes, stacked one on top of another and separated by wave-shaped external cooling fins 5. The tubes 4 are shown as having an oblong cross-section with longer substantially flat sides 6 and shorter rounded sides 7, all the tubes 4 being of substantially the same length. The tubes 4 are stacked on their flat sides 6. FIGS. 1 and 2 illustrate the core 1 as comprising a single tube stack 2, i.e. a single row of tubes 4, which is the preferred construction of the core 1.

The cooling fins 5 are shown in FIG. 2 as being thin sheets having a wave-shaped cross-section along the longitudinal axis, sandwiched between the flat sides 6 of adjacent tubes 4. The cooling fins 5 are illustrated by FIG. 2 as having a corrugated cross-section, however cooling fins 5 having other wave-shaped cross-sections, such as castellated, are also preferred.

The wave-shaped cooling fins 5 define air passages 8 transverse to the longitudinal axis between adjacent tubes 4 in the tube stack 2, allowing cooling air to pass over substantially the entire surface of the tubes 4. As is apparent from FIGS. 1 and 2, the higher the number of wave forms per unit length in the cooling fin 5, the larger will be the surface area of the cooling fin 5 over which air may pass. Therefore, the efficiency of the heat exchanger is increased to a certain extent by increasing the number of wave forms per unit length in the cooling fin 5.

Both tubes 4 and cooling fins 5 may be made from aluminum, in which case they are joined together by brazing. It is preferred that the tubes 4 and external fins 5 are made from copper, in which case they may be joined together by soldering.

FIGS. 1 and 2 show that the external fins 5 do not extend over the entire length of tubes 4, terminating a short distance from both ends of the tubes 4. As best shown in FIG. 3, the portions at the ends of tube 4 over which fin 5 does not extend project through locating plate 3 in the assembled core 1.

FIGS. 2 and 3 also show internal supporting fins 9 inside tubes 4. These internal supporting fins 9 are similar in appearance to the external cooling fins 5 in that they are thin plates having a wave-shaped cross-section. The internal fins 9 have a wave-shaped cross-section transverse to the longitudinal axis, thus defining fluid passages 10 through the tubes 4. In FIGS. 2 and 3, the internal fin 9 is shown as having a castellated cross-section. However, internal fins 9 having other shapes, such as corrugated, are also preferred.

FIG. 2 illustrates an exploded view of header tank 12, comprising manifold 13, header plate 14 and resilient grommets 15. In an assembled header tank 12, header plate 14 is sealably secured to manifold 13, for example by welding, bolting or crimping. Although FIG. 2 shows the manifold 13 and header plate 14 as separate assemblies, a header tank 12 may be provided with integral manifold 13 and header plate 14. The header plate 14 is provided with holes 16 having edges 17, one hole 16 being provided for each tube 4 in the core 1. The holes 16 are of oblong shape, the same shape as tubes 4 and holes 11 in locating plate 3.

As shown in FIG. 3, the hole 16 receives an individual resilient grommet 15. Grommet 15 is provided with a bore 18 which receives the end of tube 4 and forms a fluid-tight seal with the sides 6 and 7 of tube 4. The outside wall 19 of grommet 15 is provided with a radial groove 20 which defines outer flange 21, and preferably inner flange 22. In assembled header tank 12, outer flange 21 overlies the surface of header plate 14 facing outward from header tank 12. Preferred inner flange 22 overlies the surface of header plate 14 which faces the interior of header tank 12. Resilient grommet 15 receives edge 17 of hole 16 into radial groove 20, thus forming a seal between the grommet 15 and the edge 17 of hole 16.

As shown in FIG. 3, the end of tube 4 projects completely through grommet 15, as is preferred to achieve a fluid-tight seal between tube 4 and grommet 15.

FIG. 3 shows an internal supporting fin 9 inside tube 4. It is preferred that the flat sides 6 of tube 4 engage internal fin 9. This allows internal fin 9 to provide support against deformation by inward pressure from the resilient grommet 15, which may cause concave deformation of flat side 6 of tube 4 if the internal fin 9 were not present. Thus, it is preferred that an internal supporting fin 9 be provided inside tube 4 at least in the vicinity of grommet 15.

Furthermore, contact between internal fin 9 and tube 4 provides heat transfer between internal fin 9 and tube 4. Therefore, it is particularly preferred to provide an internal fin which extends the entire length of tube 4.

FIG. 1 schematically illustrates an assembled heat exchanger comprising a core i interposed between an upper header tank 12a and a lower header tank 12*b*.

FIG. 1 shows the core 1 as comprising oblong tubes 4 (only the shorter rounded sides 7 of which are visible in this frontal view), longitudinal wave-shaped external cooling fins 5 between the tubes 4, upper locating plate 3*a* and lower locating plate 3*b*. The locating plates 3*a* and 3*b* are provided with holes 11 which receive the ends of tubes 4 in a close fit. The holes 11 in respective plates 3*a* and 3*b* are preferably in registry in order to accurately align the tubes 4 relative to one another. The core 1 is preferably a rigid unitary structure, with tubes 4 and cooling fins 5 being brazed or soldered together, and tubes 4 being received in the holes 11 in locating plates 3*a* and 3*b* by either a friction fit or by soldering or brazing tubes 4 to locating plates 3*a* and 3*b*.

FIG. 1 shows upper header tank 12*a* as comprising manifold 13*a*, header plate 14*a* and grommets 15. Upper manifold 13*a* is provided with a fluid inlet 33 through which coolant enters the heat exchanger. Also shown is lower header tank 12*b* comprising manifold 13*b*, header plate 14*b* and grommets 15. Lower manifold 13*b* is provided with a fluid outlet 34 through which coolant leaves the heat exchanger after passing through tubes 4.

The header tanks 12*a* and 12*b* are schematically shown in FIG. 1 as being provided with flanges 30 attached to the sides of the header tanks 12*a* and 12*b*. Flanges 30 are each shown as being fastened to frame members 31 by means of bolts 32. This construction functions to maintain the header tanks 12*a* and 12*b* in rigid relation to one another. Frame members 31 preferably are connected to, or form a part of, the chassis of the vehicle in which the heat exchanger is installed. It is to be understood that FIG. 1 schematically shows one way in which header tanks 12*a* and 12*b* may be secured to a vehicle chassis in rigid relation to each other. It is also to be understood that there are numerous other ways in which this may be accomplished, including numerous other ways in which a side frame can be attached to header tanks 12*a* and 12*b*. The particular way in which the header tanks 12*a* and 12*b* are secured to a vehicle chassis in rigid relation to one another is not an essential feature of the present invention.

FIG. 1 illustrates a particularly preferred embodiment of the present invention in which the outer flange 21 of each grommet 15 in the upper header tank 12*a* is sandwiched between header plate 14*a* and upper locating plate 3*a*. Likewise, the outer flange 21 of each grommet 15 in the lower header tank 12*b* is sandwiched between header plate 14*b* and lower locating plate 3*b*.

In actual use in a vehicle, heat exchangers such as that shown in FIG. 1 may be subject to severe mechanical shocks. The most common type of mechanical shock is likely to be produced when the vehicle encounters bumps, thus causing the chassis, and any parts attached to the chassis such as a heat exchanger, to be severely jolted in a vertical direction.

In the heat exchanger shown in FIG. 1, vertical jolts to the chassis are transferred to header tanks 12*a* and 12*b*, which transfer the shocks to core 1, the shocks being reduced somewhat by the cushioning effect of grommets 15. It is apparent that vertical shocks could cause axial movement of the tubes 4. However, the abutment of locating plates 3*a* and 3*b* with outer flanges 21 prevents the tubes 4 from moving axially. Any forces on the core 1 resulting from vertical shocks are transferred from locating plates 3*a* and 3*b*, through grommets 15 to the header plates 14*a* and 14*b*. Were it not for locating plates 3*a* and 3*b*, over time vertical shocks could cause tubes 4 to move axially downward and gradually become dislodged from the upper header tank 12*a*. This would result in failure of the heat exchanger.

Thus, the heat exchanger shown in FIG. 1, by preventing the tubes 4 from becoming dislodged from the grommets 15 by axial movement, provides improved durability over previously known heat exchangers with grommetted tubes.

In order to prevent axial movement of the tubes 4, the tubes 4 of the heat exchanger shown in FIG. 1 must be prevented from moving axially relative to the locating plates 3*a* and 3*b*. This may preferably be accomplished by soldering or brazing the tubes 4 to the locating plates 3*a* and 3*b*, as discussed above. However, this may also be accomplished merely by closely fitting the tubes 4 within the holes 11 of the locating plates 3*a* and 3*b* and having the cooling fins 5 extend over the entire length of the tubes 4 between the locating plates 3*a* and 3*b*, so that the fins 5 abut locating plates 3*a* and 3*b*, shown in FIG. 1. Since the cooling fins 5 are soldered or brazed to the tubes 4, abutment of the fins 5 against locating plates 3*a* and 3*b* also prevents axial movement of the tubes 4 relative to the locating plates 3*a* and 3*b*.

One preferred method of assembling a heat exchanger as shown in FIGS. 1 to 3 is to first form a rigid unitary core 1 having accurately aligned tubes 4 and then to insert the ends of the tubes 4 into header plates 14 having grommets 15. The manifolds 13 may then be bolted or crimped to the header plates 14 to complete the assembly. Another preferred method of assembly is to join the header plate 14 and manifold 13 by welding and then insert the ends of the tubes 4 into the pre-assembled header tank 12.

The core 1 is preferably formed by first assembling a tube stack 2 as shown in FIG. 2, with wave-shaped external cooling fins 5 soldered or brazed to the tubes 4, and then inserting the ends of tubes 4 through holes 11 in the locating plates 3. The tubes 4 are preferably soldered or brazed in place in the holes 11 of the locating plates 3, however a friction fit between the holes 11 and tubes 4 will suffice to produce a rigid core 1.

The core 1 may preferably include internal supporting fins 9 located inside tubes 4. Since the tubes 4 are preferably seamless, it is necessary to insert supporting fins 9 axially into tubes 4. One preferred method comprises providing fin 9 of a thickness slightly less than the thickness of the tube 4 so that fin 9 can be fitted axially into tube 4 and, when inserted, engages both flat sides 6 of tube 4.

Another preferred method of inserting fin 9 into tube 4 is to provide a tube 4 of oblong or nearly oblong shape which can easily accept fin 9 axially, so that when fin 9 is inserted it does not engage both flat sides 6 of tube 4. The tube 4 containing fin 9 is then compressed so that the tube 4 adopts an oblong shape and both flat sides 6 of tube 4 engage fin 9. This final compression can be accomplished by compressing each tube 4 individually or by compressing an assembled tube stack 2 in a press.

Although the invention has been described in connection with certain preferred embodiments, it is not intended that it be limited thereto. Rather, it is intended that the invention cover all alternate embodiments as may be within the scope of the following claims.

The embodiments of the invention in which an exclusive property or privilege is claimed are defined as follows:

1. A heat exchanger, comprising a core interposed between first and second header tanks, wherein:

(a) said core comprises (i) a plurality of substantially parallel open-ended tubes having first and second ends, all the tubes being of substantially equal length, each tube having a substantially oblong cross section with longer substantially flat sides and shorter rounded sides;

(ii) first and second substantially flat locating plates transverse to the tubes, each locating plate having a plurality of holes shaped to closely fit over the ends of the tubes, the first and second ends of the tubes projecting through the holes in the first and second locating plates respectively, the holes in the respective locating plates being in registry with one another so as to precisely align the tubes relative to one another; and (iii) a plurality of external cooling fins extending longitudinally along the tubes substantially an entire distance between the first and second locating plates, said fins comprising thin plates having a wavy cross section along a longitudinal axis parallel to the length of the tubes, said fins being sandwiched between the flat sides of adjacent tubes to define a plurality of air passage between said adjacent tubes substantially transverse to the longitudinal axis;

(b) each of said header tanks comprising (i) a substantially flat header plate transverse to the longitudinal axis, the header plate having an inner surface facing an inside of the header tank and an outer surface facing an outside of the header tank, a plurality of holes being formed through the header plate to receive the ends of the tubes, the header plate holes having edges about their periphery;

(ii) individual resilient grommets in said header plate holes, the grommets having an outside wall and a central bore adapted to form a fluid tight seal with the sides of the tubes, an outer flange on the outside wall of the grommet, the outside wall being adapted to receive the edges of the header plate hole so that the outer flange overlies the outer surface of the header plate and a fluid-tight seal is formed between the grommet and the edges of the header plate hole;

wherein the first end of each tube is received in the grommet bore in the first header tank and the second end of each tube is received in the grommet bore in the second header tank, the ends of the tubes projecting through the grommet bores;

wherein each tube is provided with an internal supporting fin which extends longitudinally through the tube at least where the tube passes through the header plates in the grommet bores, the internal fin extending between the two flat sides of the tube to assist in supporting the flat sides of the tube against deformation towards each other, the internal fin comprising a thin plate having a wavy cross section transverse to the longitudinal axis and defining a plurality of longitudinal passageways through the tube; and wherein the locating plates engage the outer flanges of the resilient grommets, thereby sandwiching the outer flanges between the locating plates and the header plates, the header plates being fixed against movement relative to one another, the locating plates being secured to the tubes, whereby engagement of the locating plates on the outer flanges prevents the tubes from sliding axially out of engagement with the grommet bores.

2. A heat exchanger according to claim 1, wherein the internal supporting fin has a castellated cross section transverse to the longitudinal axis.

3. A heat exchanger according to claim 1, wherein the external cooling fins extend longitudinally along the entire length of the tubes between the first and second locating plates and abut the first and second locating plates.

4. A heat exchanger according to claim 1, wherein the external cooling fins have a corrugated cross section along the longitudinal axis.

5. A heat exchanger according to claim 1, wherein the tubes are received in the holes of the locating plates in a friction fit.

6. A heat exchanger according to claim 1, wherein the tubes are secured to the locating plates by soldering or brazing.

7. A heat exchanger according to claim 1, wherein the external cooling fins are secured to the tubes by soldering or brazing.

8. A heat exchanger according to claim 1, wherein the internal supporting fins are secured inside the tubes by means of a friction fit, soldering or brazing.

9. A heat exchanger according to claim 1, wherein the tubes, external fins and internal fins comprise aluminum or copper.

10. A heat exchanger according to claim 1, wherein the locating plates comprise brass or aluminum and the resilient grommets comprise silicon rubber.

11. A heat exchanger according to claim 1, wherein the tubes are centred laterally in the grommet bores to within $1\times10^{-2}$ to $5\times10^{-3}$ inches of their desired positions.

12. A heat exchanger according to claim 1, wherein the outside wall of each grommet having a radial groove facing outward from said bore, the groove defining said outer flange, and the groove being adapted to receive the edge of the header plate hole in a fluid tight sealed relation.

13. A heat exchanger comprising a core interposed between first and second header tanks, wherein:

(a) said core comprises (i) a plurality of substantially parallel open-ended tubes having first and second ends, all the tubes being of substantially equal length, each tube having a substantially oblong cross section with longer substantially flat sides and shorter rounded sides;

(ii) first and second substantially flat locating plates transverse to the tubes, each locating plate having a plurality of holes shaped to closely fit over the ends of the tubes, the first and second ends of the tubes projecting through the holes in the first and second locating plates respectively, the holes in the respective locating plates being in registry with one another so as to precisely align the tubes relative to one another; and (iii) a plurality of external cooling fins extending longitudinally along the tubes between the first and second locating plates, said fins being sandwiched between the flat sides of adjacent tubes to define a plurality of air passages between said adjacent tubes substantially transverse to the longitudinal axis;

(b) each of said header tanks comprising (i) a substantially flat header plate transverse to the longitudinal axis, the header plate having an inner surface facing an inside of the header tank and an outer surface facing an outside of the header tank, a plurality of holes being formed through the header plate to receive the ends of the tubes, the header plate holes having edges about their periphery;

(ii) individual resilient grommets in said header plate holes, the grommets having an outside wall and a central bore adapted to form a fluid-tight seal with the sides of the tubes, an outer flange on the outside wall of the grommet, the outside wall being adapted to receive the edges of the header plate hole so that the outer flange overlies the outer surface of the header plate and a fluid-tight seal is formed between the grommet and the edges of the header plate hole;

wherein the first end of each tube is received in the grommet bore in the first header tank and the second end of each tube is received in the grommet bore in the second header tank, the ends of the tubes projecting through the grommet bores;

wherein each tube is provided with an internal supporting fin means which extends longitudinally through the tube at least where the tube passes through the header plates in the grommet bores, the internal fin means extending between the two flat sides of the tube to assist in supporting the flat sides of the tube against deformation towards each other; and wherein the locating plates engage the outer flanges of the resilient grommets, thereby sandwiching the outer flanges between the locating plates and the header plates, the header plates being fixed against movement relative to one another, the locating plates being secured to the tubes, whereby engagement of the locating plates on the outer flanges prevents the tubes from sliding axially out of engagement with the grommet bores.

14. A heat exchanger according to claim 13, wherein the external cooling fins extend longitudinally along the entire length of the tubes between the first and second locating plates and abut the first and second locating plates.

15. A heat exchanger according to claim 14, wherein the tubes are received in the holes of the locating plates in a friction fit.

16. A heat exchanger according to claim 15, wherein the locating plates comprise brass or aluminum and the resilient grommets comprise silicon rubber.

17. A heat exchanger according to claim 16, wherein the outside wall of each grommet having a radial groove facing outward from said bore, the groove defining said outer flange, and the groove being adapted to receive the edge of the header plate hole in a fluid tight sealed relation.

18. A heat exchanger as claimed in claim 13, consisting of a single row of said oblong tubes arranged with the flat sides of each tube parallel to the flat sides of adjacent tubes.

* * * * *